US005233856A

United States Patent [19]

Shimanovski et al.

[11] Patent Number: 5,233,856

[45] Date of Patent: Aug. 10, 1993

[54] EXTERNAL SEAL UNIT FOR TUBE HYDROFORMING

[75] Inventors: Bruce S. Shimanovski, Southfield; George T. Winterhalter, Sr., Berkley; Daniel E. Sobecki, Troy, all of Mich.

[73] Assignee: General Motors Corporation, Detroit, Mich.

[21] Appl. No.: 890,189

[22] Filed: May 29, 1992

[51] Int. Cl.[5] ..... B21D 22/10

[52] U.S. Cl. ..... 72/62; 72/61

[58] Field of Search ..... 72/57, 58, 59, 60, 61, 72/62; 279/2.17, 46.2

[56] References Cited

U.S. PATENT DOCUMENTS

| | | | |
|---|---|---|---|
| 2,458,854 | 1/1949 | Hull et al. | 72/58 |
| 4,189,162 | 2/1980 | Rasmussen et al. | 279/4 |
| 4,267,718 | 5/1981 | Benteler et al. | 72/59 |
| 4,319,471 | 3/1982 | Benteler et al. | 72/59 |
| 4,393,674 | 7/1983 | Rasmussen | 72/61 |
| 4,460,200 | 7/1984 | Rasmussen et al. | 285/18 |

FOREIGN PATENT DOCUMENTS

| | | | |
|---|---|---|---|
| 2111139 | 6/1983 | United Kingdom | 72/62 |

*Primary Examiner*—Lowell A. Larson

*Assistant Examiner*—Michael J. McKeon

*Attorney, Agent, or Firm*—Charles E. Leahy

[57] ABSTRACT

A seal device for a hydroforming press includes a housing having a cylindrical bore and a cylindrical seal carrier slidable within the housing bore. The seal carrier has a bore and a tube support which fit closely on outside and inside of the end of the tube to be hydroformed. An actuator is operable to forcibly move the seal carrier from a retracted position withdrawn away from the end of the tube to an extended position in which the seal carrier is installed over the end of the tube. A resilient elastomeric annular seal is carried by the seal carrier and encircles the outer circumference of the tube with some clearance. A seal actuator carried on the seal carrier compresses the seal upon relative movement between the seal actuator and the seal carrier so that the seal is forced radially inwardly to seal against the tube. A stop is engaged by the seal actuator as the seal actuator approaches the fully extended position so that the subsequent further movement of the seal carrier then compresses the seal against the tube. The stop may be fixedly mounted to the housing, or alternatively, the die may serve as the stop by closing the dies about the tube so that the movement of the seal carrier to the extended position causes the seal actuator to engage the die.

12 Claims, 4 Drawing Sheets

EXTERNAL SEAL UNIT FOR TUBE HYDROFORMING

The invention relates to a seal unit for sealing engagement on the outer surface of a tube in a hydroforming press.

BACKGROUND OF THE INVENTION

It is well known in the prior art that a tube may be hydroformed to a desired complex tubular shape. The tube is placed between a pair of dies having cavities which define the desired resultant shape of the tube. The ends of the tube are accessible through the die and a seal is connected to the ends of the tube so that pressurized fluid injected into the tube forces the tube to expand and conform to the shape defined by the die cavity. It also known to mount the dies in a press so that a lower die is stationary on the lower bed of the press and the upper die moves up and down with the bed of the press to permit loading and unloading of the tubes from the die.

Co-pending patent application Ser. No. 07/881,275 assigned to the assignee of this invention, provided improvements in the press apparatus and in the mounting of a seal unit on the press.

The present invention provides a new and improved seal for sealing engagement on the outer surface of the tube end in a hydroforming press.

SUMMARY OF THE INVENTION

A seal device sealingly engages on the outer surface of the end of a tube to be hydroformed within a die cavity formed between a pair of dies. The seal device includes a housing having a cylindrical bore and a cylindrical seal carrier slidable within the housing bore. The seal carrier has a carrier bore at the end thereof adapted for close fitting installation over the end of the tube to be hydroformed. An actuator is operable to forcibly move the seal carrier from a retracted position withdrawn away from the end of the tube to an extended position in which the seal carrier is installed over the end of the tube with the tube end seated in the bore of the carrier. A resilient elastomeric annular seal is carried by the seal carrier within the carrier bore thereof and encircles the outer circumference of the tube. A seal actuator is slidably carried on the seal carrier and adapted to compress the seal upon relative movement between the seal actuator and the seal carrier so that the seal is forced radially inwardly to tightly engage the outer surface of the tube. A stop element is engaged by the seal actuator as the seal actuator approaches the fully extended position so that the seal actuator is stopped against further movement and the subsequent further movement of the seal carrier then compresses the seal about the outer surface of the tube. The stop element may be fixedly mounted to the housing, or alternatively, the die may serve as the stop element by having the movement of the seal carrier to the extended position causes the seal actuator to engage the die.

DESCRIPTION OF THE PREFERRED EMBODIMENT

Figure 1:
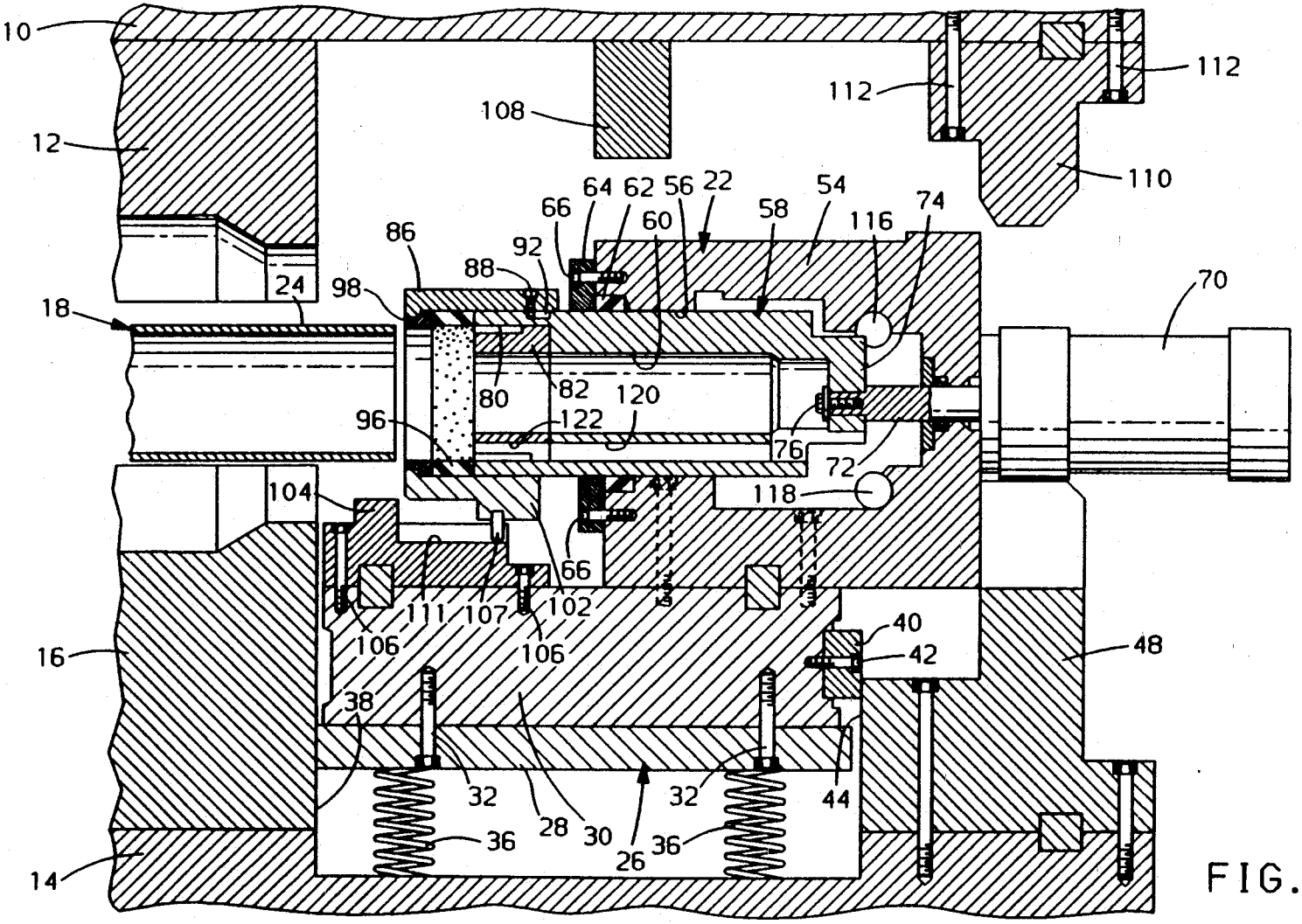
FIG. 1 is a side elevation view showing the hydroform press and the seal unit with parts broken away and in section and the press open and the seal unit withdrawn away from the end of the tube.

Referring to FIG. 1, a press includes an upper bed 10 carrying an upper die 12, and a lower bed 14 carrying a lower die 16. A tube 18, to be hydroformed, is held between the opened dies 12 and 16 by a robot or other suitable mechanism. A seal unit generally indicated at 22 is provided for sealing engagement on the outer surface 24 of tube 18. The other end of the tube, not shown, may be sealed by a like seal unit.

The seal unit 22 is mounted on a spring loaded elevator, generally indicated at 26, and comprised of plates 28 and 30 attached together by bolts 32. The elevator 26 is yieldably supported by springs 36. The FIG. 1 left-hand end of plate 28 slides on wall 38 of die 16, and a guide block 40 attached to plate 30 by bolts 42 rides on an end wall 44 of guide block 48. Accordingly, the elevator 26 is free to move vertically under the resilient urging of the springs 36, but is restrained against horizontal movement by the end walls 38 and 44.

Seal unit 22 includes a housing 54 having a cylindrical bore 56 therein. A cylindrical seal carrier 58 is slidable within the housing bore 56 and has a central fluid passage 60 extending therethrough. An annular seal 62 is mounted in a recess of the housing bore 56 and is retained by a retaining ring 64 and bolts 66. The seal 62 encircles the seal carrier 58 to provide a fluid tight seal between the seal carrier 58 and the housing 54.

A hydraulic cylinder 70 is mounted on the housing 54 and has a piston rod 72 attached to a wall 74 of the seal carrier 58 by a bolt 76. The hydraulic cylinder 70 serves as an actuator to move the seal carrier 58 left and right between a retracted position of FIG. 1 in which the seal carrier 58 is withdrawn away from the end of the tube 18, and an extended position of FIGS. 2 and 3 in which seal the carrier 58 is installed over the end of the tube 18.

Figure 2:
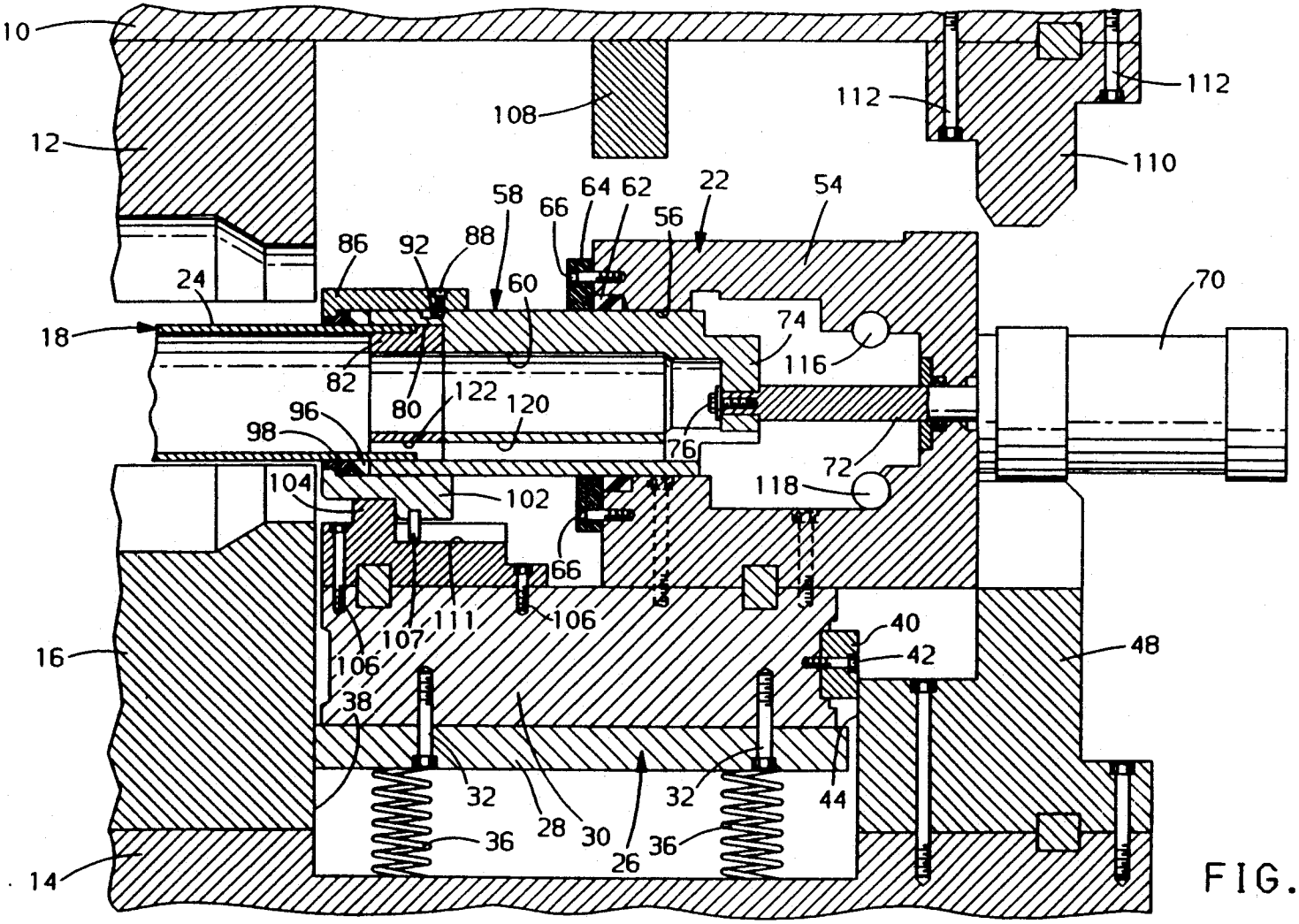
FIG. 2 is a view similar to FIG. 1 but showing the seal unit in the extended position sealingly engaging the outer surface of the tube.

As best seen in FIG. 1, the bore 60 is stepped at its outer end to provide a entry opening 80 by which the seal carrier 58 may be installed over the end of the tube 18 as shown in FIG. 2. An annular tube support 82 is mounted on seal carrier 58 within the entry opening 80 to extend inside the tube 18 as shown in FIG. 2 when the seal carrier 58 is extended.

A cylindrical seal actuator 86 is slidably carried on the outer circumference of seal carrier 58. A plurality of stop bolts 88, one of which is shown in FIG. 1, projects radially inward from the seal actuator 86 and seats in a slot 92 to provide a motion limiting connection that limits the range of sliding movement of the seal actuator 86 on the seal carrier 58 is determined by the length of the slot 92. As best seen in FIG. 1, an annular seal 96 of resilient elastomeric material is carried on the seal carrier 58 by the seal actuator 86 and an anchor ring 98 attached to the seal actuator 86. The inside diameter of the seal 96 is preferably about 0.100 inches larger than the tube 18. The seal actuator 86 has an actuating leg 102 depending therefrom and normally spaced away from a stop element 104 attached to elevator 26 by bolts 106. A guide pin 107 is attached to actuator 86 and rides in a groove 111 or stop element 104 to prevent rotation of seal actuator 86. The stop bolt 88 of seal actuator 86 engages slot 92 to prevent rotation of seal carrier 58.

Operation

FIG. 1 shows the dies 12 and 16 in the open position so that the tube 18 can be loaded between the dies by a robot or other suitable mechanism. The actuator 70 establishes the seal carrier 58 in its retracted position of FIG. 1 so that the seal actuator 86 of the seal unit 22 is withdrawn away from the tube 18.

After the tube 18 is loaded and properly positioned, the hydraulic cylinder 70 is actuated as shown in FIG. 2 to extend the seal carrier 58 leftwardly to the extended position in which the seal carrier 58 is installed onto the end of tube 18. As seen in FIG. 2, the outer surface 24 of the tube 18 is closely surrounded by the walls of seal carrier 58 defining the entry opening 80. Likewise, the inner surface of the tube 18 is supported by the annular tube support 82 which reaches inside the tube 18. As the seal carrier 58 has approached the fully extended position shown in FIG. 2, the stop tab 102 of seal actuator 86 has been carried into engagement with the stop element 104. Accordingly, the final leftward movement of the seal carrier 58 to fully extended position has caused the annular seal 96 to be compressed between the end face of the seal carrier 58 and the anchor ring 98 carried by seal actuator 86. This compression of the annular seal 96 has caused the seal to be compressed radially inward into tight fluid sealing engagement with the outer surface 24 of the tube 18.

Figure 3:
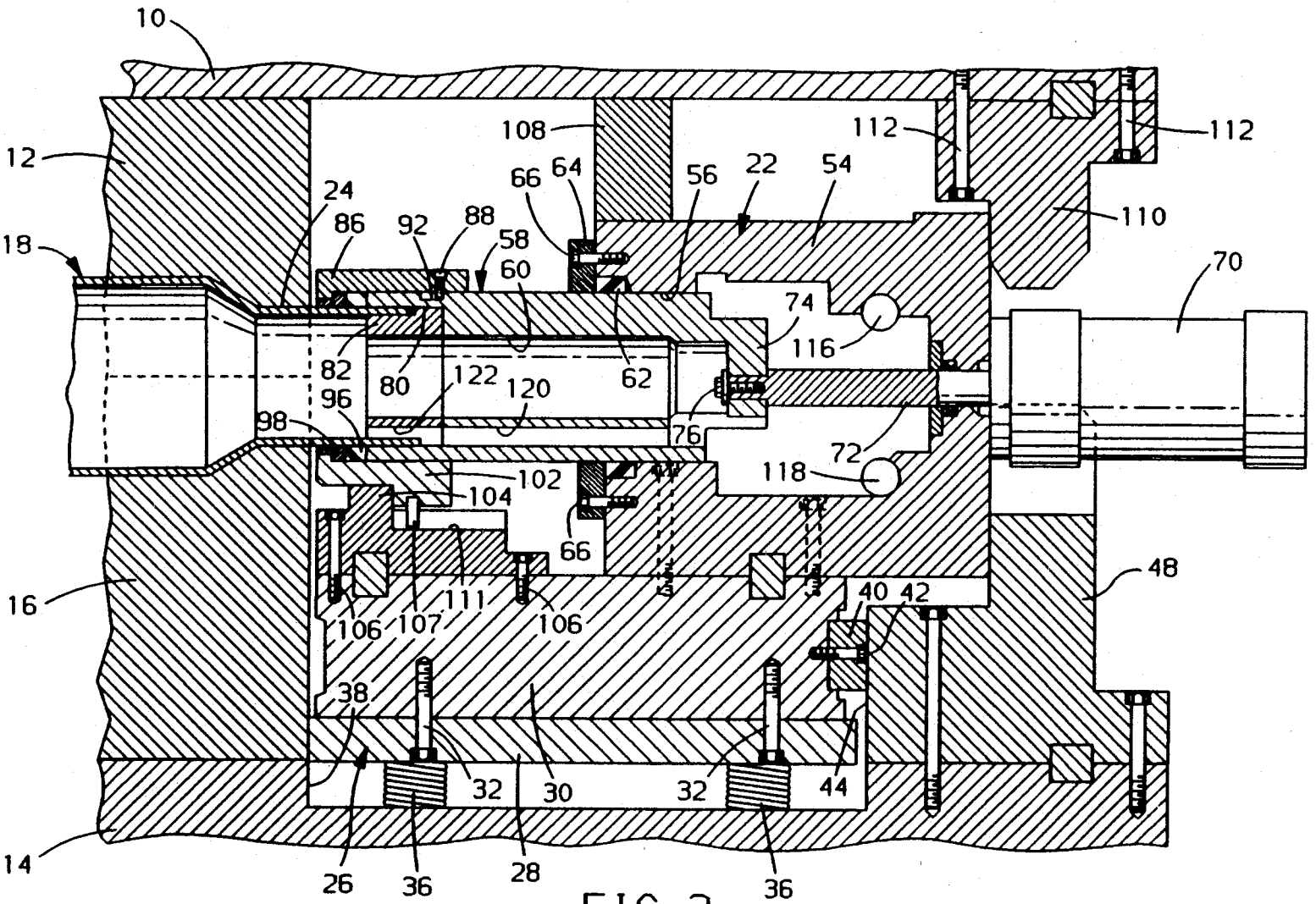
FIG. 3 is a view similar to FIG. 2 but showing the dies closed about the tube.

FIG. 3 shows the upper bed 10 of the press having been lowered to lower the upper die 12 onto the tube 18 and the lower die 16. During such lowering of the upper die 12, the housing 54 of seal unit 22 has been engaged by a pusher block 108 depending from the upper bed 10 so that the seal unit 22 and the elevator 26 on which the seal unit 22 is mounted have been pushed downwardly as permitted by the collapse of springs 36. In this manner, the seal unit 22 has been lowered in unison with the tube 18 as the dies have been closed about the tube 18.

Simultaneously, as shown in FIG. 3, a heel block 110 attached to the upper bed 10 by bolts 112 has been lowered into blocking juxtaposition with the end face 112 of the housing 54. Accordingly, when high pressure hydraulic fluid is introduced into the tube 18 via fluid inlet port 116, the heel block 110 will assist in anchoring the housing 54 against any rightward movement. In addition, it is seen in FIG. 1 that the diameter of the seal carrier sliding in the housing bore 56 is larger than the diameter of the tube 18 so that the hydraulic pressure acting on the seal carrier exerts a greater force in the leftward direction than in the rightward direction.

After the tube 18 has been expanded into the die cavity, as shown in FIG. 3, the fluid is drained from the tube 18 via a drain port 118, a drain passage 120 of the seal carrier 58, and a drain passage 122 of the tube support 82. The hydraulic cylinder 70 is then actuated to retract the seal carrier 58 rightwardly away from engagement with the end of tube 18. As the seal carrier 58 is withdrawn rightwardly, the stop bolt 88 causes the seal actuator 86 to be carried rightwardly so that the elastomeric seal 96 is permitted to expand axially and thereby expand radially to relieve the sealing force on the end of the tube 18. The further retracting motion of the seal carrier 58 fully disengages the seal unit 22 from the end of the tube 18 as shown in FIG. 1. Accordingly, the dies 12 and 16 may be opened and the hydroformed tube 18 removed therefrom.

Figure 4:
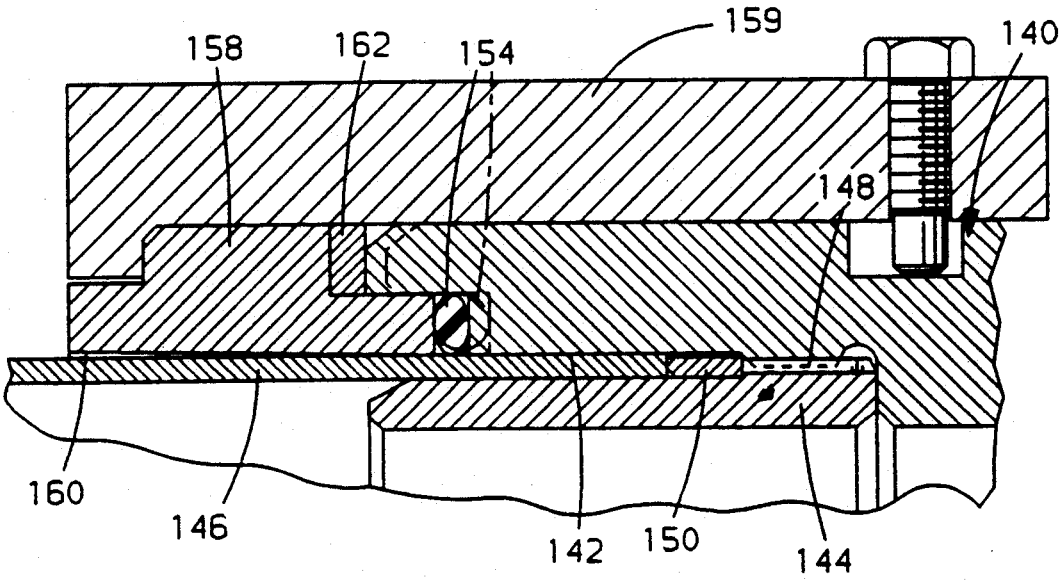
FIG. 4 is fragmentary view of the seal unit showing a first modification of the seal unit.

FIG. 4 shows a modification of the seal unit 22 in which a seal carrier 140 has a tube entry opening 142. A tube support 144 is mounted inside the entry opening 142 to fit inside the tube 146. The tube support 144 is mounted in the seal carrier 140 by thread 148. A removable stop ring 150 encircles the tube support 144 and may be readily removed and replaced by either a longer or shorter ring 150 to easily adapt the seal unit to tubes 146 of differing lengths. Alternatively, the stop ring 15 may be integral part of the tube support 144.

Referring again to FIG. 4, it is seen that the elastomeric seal is a conventional O-ring 154 and is seated between the seal carrier 140 and a seal anchor ring 158 of the seal actuator 159. The seal anchor 158 has a tapered inner wall 160 which facilitates the installation of the seal unit onto the end of the tube 146. An annular spacer ring 162 is interposed between the seal anchor 158 and the seal carrier 140 so that the thickness of the spacer 162 will control the extent to which the O-ring 154 is compressed upon the engagement of the seal actuator 159 with the stop element, not shown. Depending on the smoothness or other characteristic of the outer tube 146, it may be desirable to vary the extent of compression experienced by the O-ring 154. In order to vary the extent of seal compression, the seal anchor ring 158 is removed and the spacer ring 162 is replaced by a spacer ring of either greater or lesser thickness.

Figure 5:
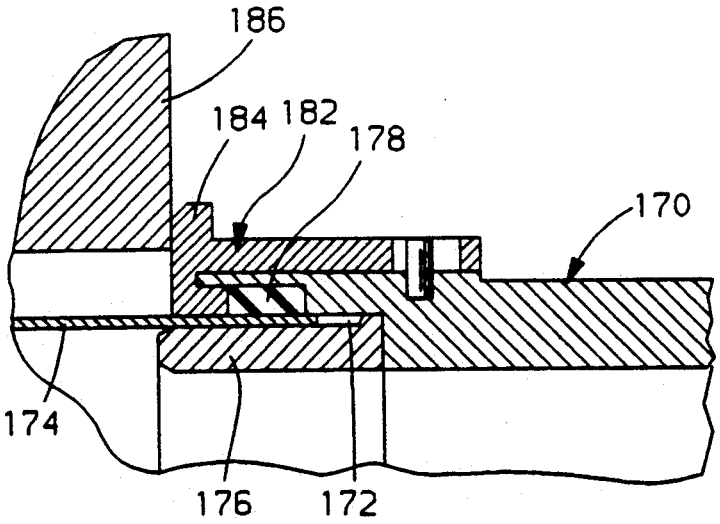
FIG. 5 is a view similar to FIG. 4 but showing a second modification of the seal unit.

FIG. 5 shows yet another modification of the invention in which a seal carrier 170 has an entry opening 172 for the tube 174. Tube support 176 is mounted in the entry opening 172 and extends inside the tube 174. The annular seal 178 is carried on the seal carrier by the seal actuator 182. FIG. 5 shows the seal carrier 170 having moved leftwardly to a partially extended position in which a stop leg 184 of the seal actuator 182 has been carried into engagement with the upper die 186. Accordingly, further leftward movement of the seal carrier 170 will cause the elastomeric seal 178 to be compressed because the seal actuator 182 is stopped against further leftward movement.

It will be understood that FIG. 5 shows the upper die 186 prior to being fully lowered onto the lower die. In this manner the seal unit may be engaged on the end of the pipe and pressure fluid introduced into the pipe before the upper die 186 is further closed onto the lower die. Alternatively, the upper die 186 may be fully closed onto the lower die prior to the leftward extension of the seal carrier 170 so that the upper die 186 is fully lowered before being engaged by the seal actuator 182.

It will be understood that the foregoing description of the preferred embodiment of FIGS. 1-3 and the two modifications of FIGS. 4 and 5 are only exemplary of applicant's invention and further modifications may be made within the scope of the appended claims. For example, it will be understood that the invention is not limited to the use of a seal carrier slidable within a bore of a fixed housing, but rather the seal carrier may be otherwise movably mounted on a fixed housing for extension and retraction with respect to the tube. Furthermore, although the embodiment of FIGS. 1-3 shows only a single stop element 104 engaged by the actuating leg 102 of the seal actuator 86, it may be desirable to have the actuating leg structure of the seal actuator 86 and the stop element 104 of the housing extend further around the circumference of the seal actuator 86 in order to assure uniform application of compression force on the annular seal 96. However, the stop element 104 should not interfere with the loading of the tube 18 into the die.

Thus it is seen that the invention provides a new and improved seal device for use in a hydroforming process.

The embodiments of the invention in which an exclusive property or privilege is claimed are defined as follows:

1. In an apparatus for hydroforming a tube between a pair of dies, a seal device for sealing engagement on the outer surface of the end of a tube and for communicating pressure fluid into the tube, comprising:

a housing, a seal carrier movably mounted on the housing, said seal carrier having an entry opening adapted for installation over the end of the tube, an actuator operable to move the seal carrier between a retracted position withdrawn away from the end of the tube and an extended position in which the seal carrier is installed over the end of the tube with the tube end seated in the entry opening of the seal carrier, said seal carrier having a seal actuator movably mounted on the seal carrier for movement relative thereto, a resilient elastomeric annular seal carried by the seal carrier within the entry opening thereof and encircling the outer surface of the tube end, said seal being compressed upon relative movement between the seal actuator and the seal carrier so that the seal is compressed inwardly to sealingly engage the outer surface of the tube, and a stop element engaged by the seal actuator as the seal carrier approaches the extended position so that the seal actuator is stopped against further movement and the further movement of the seal carrier to the extended position then compresses the seal about the outer surface of the tube.

2. In an apparatus for hydroforming a tube between a pair of dies, a seal device for sealing engagement on the outer surface of the end of a tube and for communicating pressure fluid into the tube, comprising:

a housing having a cylindrical bore;

a cylindrical seal carrier slidable within the housing bore and having a fluid passage therethrough, said seal carrier having a carrier bore adapted for installation over the end of the tube, an actuator operable to forcibly move the seal carrier between a retracted position withdrawn away from the end of the tube and an extended position in which the seal carrier is installed over the end of the tube, a resilient elastomeric annular seal carried by the seal carrier within the carrier bore thereof and encircling the outer surface of the tube, a seal actuator slidably carried on the seal carrier and adapted to compress the seal upon relative movement between the seal actuator and the seal carrier so that the seal is forced radially inwardly to tightly engage the outer surface of the tube, and;

a stop element engaged by the seal actuator as the seal carrier approaches the fully extended position so that the seal actuator is stopped against further movement and the further movement of the seal carrier then compresses the seal about the outer surface of the tube.

3. The seal device of claim 2 further characterized by means acting between the seal actuator and the seal carrier to define and limit the range of permissible movement between the seal carrier and the seal actuator to thereby control the compression of the seal.

4. The seal device of claim 3 further characterized by the means acting between the seal actuator and the seal carrier being a bolt projecting radially inward from the seal actuator and riding in a recess in the seal carrier.

5. The seal device of claim 2 further characterized by the stop element being fixedly associated with the housing so that the seal actuator engages with the stop element to stop the movement of the seal actuator toward the extended position.

6. The seal device of claim 2 further characterized by the stop element being one of the dies closed about the tube and said die being engaged by the seal actuator to stop the movement of the seal actuator toward the extended position.

7. The seal device of claim 2 further characterized by an anchor ring carried on the seal actuator and engaging the seal to compress the seal upon relative movement between the seal actuator and the seal carrier, and the anchor ring being substantially harder than the tube.

8. The seal device of claim 2 further characterized by a removable spacer ring interposed between the seal actuator and the seal carrier to define the limit of permissible movement therebetween, said spacer ring being removable and replaceable with a spacer ring of different dimension to change the extent of compression of the seal.

9. In an apparatus for hydroforming a tube between a pair of dies, a seal device for sealing engagement on the outer surface of the end of a tube and for communicating pressure fluid into the tube, comprising:

a housing having a cylindrical bore;

a cylindrical seal carrier slidable within the housing bore and having a fluid passage therethrough, said seal carrier having a carrier bore adapted for close fitting installation over the end of the tube, an actuator operable to forcibly carrier between a retracted position withdrawn away from the end of the tube and an extended position in which the seal carrier is installed over the end of the tube, a resilient elastomeric annular seal carried by the seal carrier within the carrier bore thereof and encircling the outer surface of the tube, a seal actuator slidably carried on the seal carrier and adapted to compress the seal upon relative movement between the seal actuator and the seal carrier so that the seal is forced radially inwardly to sealingly engage the outer surface of the tube, a stop element engaged by the seal actuator as the seal carrier approaches the fully extended position so that the seal actuator is stopped against further movement and the further movement of the seal carrier then compresses the seal about the outer surface of the tube, and a removable spacer ring interposed between the seal carrier and the seal actuator and adapted to define and limit the range of permissible movement between the seal carrier and the seal actuator and thereby control the compression of the seal.

10. The seal device of claim 9 further characterized by means acting to prevent rotation of the seal carrier with the housing.

11. The seal device of claim 10 further characterized by a guide pin installed in the seal actuator and extending into a groove in the stop element to prevent rotation of the seal actuator and the seal carrier.

12. The device of claim 9 further characterized by the housing bore diameter being equal or greater than the tube outside diameter to maintain total force applied to the seal carrier greater than the reaction force and thereby maintaining controlled seal compression at any fluid pressure.

* * * * *